US006188861B1

(12) United States Patent
Parker et al.

(10) Patent No.: US 6,188,861 B1
(45) Date of Patent: Feb. 13, 2001

(54) TANDEM TRI-LEVEL XEROGRAPHIC APPARATUS AND METHOD FOR PRODUCING PICTORIAL COLOR IMAGES

(75) Inventors: Delmer G. Parker, Rochester; Michael M. Shahin, Pittsford, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/518,548

(22) Filed: Mar. 3, 2000

Related U.S. Application Data

(63) Continuation-in-part of application No. 09/343,502, filed on Jun. 30, 1999, now abandoned.

(51) Int. Cl.[7] ..... G03G 15/01

(52) U.S. Cl. ..... 399/299; 399/302; 430/42; 430/44

(58) Field of Search ..... 399/301, 302, 399/298, 299, 297, 179, 232, 194; 430/42, 44

(56) References Cited

U.S. PATENT DOCUMENTS

| | | | | |
|---|---|---|---|---|
| 5,221,954 | | 6/1993 | Harris . | |
| 5,223,906 | | 6/1993 | Harris . | |
| 5,337,136 | | 8/1994 | Knapp et al. . | |
| 5,807,652 | * | 9/1998 | Kovacs | 430/42 |
| 5,837,408 | * | 11/1998 | Parker et al. | 399/232 X |

* cited by examiner

*Primary Examiner*—Susan S. Y. Lee
(74) *Attorney, Agent, or Firm*—Tallam I. Nguti

(57) ABSTRACT

Apparatus and method for creating quality pictorial color images include a charging device for uniformly charging a photoconductive member of a first tri-level xerographic module to a predetermined voltage level; using a controller and a ROS device for creating tri-level latent electrostatic images including CAD image areas and DAD image areas having different voltage levels respectively; developing the CAD image areas and the DAD image areas with yellow (Y) and a first black (K1) marking materials respectively to form a first composite color separation image of a desired final pictorial image; transferring the first composite color separation image onto an intermediate transfer member; similarly forming and developing a second composite color separation image on a second tri-level xerographic module using Magenta (M) and a second black (K2) marking material; transferring the second composite color separation image, in registration with the first composite color separation image, onto the intermediate transfer member such that yellow Y and the second black K2 are superimposable; similarly forming and developing a third composite color separation image on a third tri-level xerographic module using Cyan (C) and an optional color (X1); transferring the third composite color separation image in registration with the first and the second composite color separation images, onto the intermediate transfer member to form a desired final pictorial image including desired color superimpositions; and transferring the desired final pictorial image at a substrate transfer station onto a substrate for fusing.

6 Claims, 1 Drawing Sheet

TANDEM TRI-LEVEL XEROGRAPHIC APPARATUS AND METHOD FOR PRODUCING PICTORIAL COLOR IMAGES

This application is a continuation-in-part of application Ser. No. 09/343,502, filed Jun. 30, 1999 abandoned.

BACKGROUND OF THE INVENTION

This invention relates to full color, dot next to dot, xerographic printing systems or apparatus, and more particularly to a tandem tri-level xerographic apparatus and method for producing quality pictorial color images.

Xerocolography (a form of xerography for dry color printing) is a color printing architecture which combines multi-color xerographic development with multiwavelength laser diode light sources, with a one polygon, single optics ROS and with a polychromatic, multilayered photoreceptor to provide color printing in either a single pass or in two passes. Inherently perfect registration is achieved since the various color images are all written at the same imaging station with the same ROS. In all three latent images are written in this manner. Two of the three images are immediately developable because their voltage levels are offset from a background level while the voltage level of the third image is at the time of its formation equal to the background voltage level. Before the third image can be developed, the photoreceptor must be exposed to flood illumination of a predetermined wavelength.

Xerography is capable of producing either highlight color or process color images in a single pass as well as in multiple passes. In creating full process color images, using Image-On-Image (IOI) technology, toner particles are deposited on already developed toner images. With this type of imaging, it is desirable to use Non-interactive Development (NID) in order to avoid scavenging of an already developed image.

Conventionally, full gamut color imaging in a single pass is possible using four or more voltage level images but these systems suffer from the need to form latent images by exposing through already developed images. As evidenced by the success of the commercially available highlight color machines which use tri-level imaging, the development fields which are half those of conventional xerography are practical. However, four or more voltage level images are difficult to develop because of the problems of dealing with large cleaning fields and small development fields.

In a conventional tandem architecture, four separate xerographic engines, each consisting of a ROS, a photoreceptor and a development system are used in series to develop and transfer the CMYK toners needed to produce process color images. If a special color is needed for a logo or to broaden the color gamut it must be added as a fifth xerographic engine with ROS, photoreceptor and development system. Known tandem engine imaging apparatuses require as many as four separate image registrations. As will be appreciated, the more image registrations required the more there is a possibility for image misregistration resulting in unwanted color overlapping and fringing.

Following is a discussion of prior art, incorporated herein by reference, which may bear on the patentability of the present invention. In addition to possibly having some relevance to the question of patentability, these references, together with the detailed description to follow, are intended to provide a better understanding and appreciation of the present invention.

U.S. Pat. No. 5,221,954 entitled "Single Pass Full Color Printing System Using A Quad-Level Xerographic Unit" granted to Ellis D. Harris on Jun. 22, 1993 discloses a four color toner single pass color printing system consisting generally of a raster output scanner (ROS) optical system and a quad-level xerographic unit and a tri-level xerographic unit in tandem. The resulting color printing system would be able to produce pixels of black and white and all six primary colors. The color printing system uses a black toner and toners of the three subtractive primary colors or just toners of the three subtractive primary colors.

U.S. Pat. No. 5,223,906 entitled "Four Color Toner Single Pass Color Printing System Using Two Tri-Level Xerographic Units" granted to Ellis D. Harris on Jun. 29, 1993 discloses a four color toner single pass color printing system consisting generally of a raster output scanner (ROS) optical system and two tri-level xerographic units in tandem. Only two of the three subtractive primary colors of cyan, magenta and yellow are available for toner dot upon toner dot to combine to produce the additive primary colors. The resulting color printing system would be able to produce pixels of black and white and five of the six primary colors, with pixel next to pixel printing producing all but the strongest saturation of the sixth primary color, an additive primary color. The color printing system uses either four color toners or a black toner and three color toners.

U.S. Pat. No. 5,337,136 entitled "Tandem Tri-level Process Color Printer" granted to John F. Knapp et al on Aug. 9, 1994 discloses a tandem tri-level architecture. Three tri-level engines are arranged in a tandem configuration. Each engine uses one of the three primary colors plus one other color. Spot by spot, two color tri-level images can be created by each of the engines. The spot by spot images are transferred to an intermediate belt member, either in a spot on spot manner for forming full color images or in a spot next to spot manner to form highlight and/or logo color images. The images created by the tri-level engines can also be transferred to the intermediate in a manner such that both spot next to spot and spot on spot transfer is effected.

Previous or conventional tri-level Xerographic processes typically produce registered, two color or high light color images at within a range of about 50 to 90 prints per minute. As disclosed above, the intriguing possibility of making full color images in a single pass by overprinting or superimposing two tri-level images has occurred to others. Their ideas generally take the form of either a two cycle machine or two tri-level processes in series or tandem along one continuous belt photoconductor, with each tri-level process having a separate ROS. The throughput rate for the single pass version is the same as the tri-level process itself, while throughput rate for the two cycle arrangement is half or less. Unfortunately, neither of these approaches is capable of producing a full color gamut because the two colors that make up the composite tri-level image on a single imaging module can never be superimposed, i.e., they are mutually exclusive. For example, if a tri-level image is printed using colors A & B on a single imaging module, which is then superimposed over a second tri-level image printed with colors C & D, it is possible to obtain the colors A+C, A+D, B+C, and B+D in addition to colors A, B, C and D developed one next to the other. However, it is not possible to obtain superimpositions of A+B or C+D. In this case, if ABCD represented KYMC, it would not be possible to print blue (M+C or C+D) or overprint yellow on black (K+Y or A+B).

Moreover, unless the wave length of the exposure unit used were such that the second tri-level latent image can be exposed through the pre-existing first tri-level developed image, then the above process requires that the two composite tri-level images be developed and transferred separately. This of course is not true if the two tri-level images are developed and registered "side by side" using the color set KRGB instead of that KYMC. However, if this is to be accomplished using one transfer, the second tri-level image separation must be developed with a non-contact, cloud development system which does not respond to the gradients or to the large reverse (cleaning) field associated with the companion color latent image. Unfortunately however, there is no known development system that satisfies these requirements.

Current conventional approaches to full gamut color printing include the tandem engine approach, and the multiple superposition REaD (Recharge, Expose and Develop) approach. Both can be implemented in a cyclic mode with as few as one ROS. Although a multi-cycle color process uses fewer hardware components (one charge, ROS, and cleaning station), its throughput rate is ordinarily less than, or equal to, the process speed divided by the number of process cycles. Furthermore, in the cyclic mode, each development system, and the cleaning system, (and in the case of REaD, the transfer station), must be enabled and disabled every print cycle. In addition, at least 4 color separations must be registered.

One pass REaD requires a single, long photoreceptor to accommodate four or more recharge, expose and development stations. The manufacturing yield on long, defect free, belt PCs is very low at present. Photoconductors of the length required for REaD also cause tracking/registration problems and are difficult to replace in the field.

There is therefore a need for a relatively simpler YKMC system in which image portions or spots can be printed, not only in YKMC, but also in Y+K superimposed, and M+C or in general with the two colors on any imaging module superimposed, thereby extending the color gamut and achieving pictorial quality final images.

SUMMARY OF THE INVENTION

In accordance with one aspect of the present invention, there is provided a method for creating quality pictorial color images using duplicate color, three tri-level xerographic modules. The method includes the steps of uniformly charging a photoconductive member of a first tri-level xerographic module to a predetermined voltage level; creating tri-level latent electrostatic images including CAD image areas and DAD image areas having different voltage levels respectively; developing the CAD image areas and the DAD image areas with yellow (Y) and a first black (K1) marking material respectively to form a first composite color separation image of a desired final pictorial image.

The method then includes the steps of transferring the first composite color separation image onto an intermediate transfer member; similarly forming and developing a second composite color image using Magenta (M) a and second black (K1) marking material on a second tri-level xerographic module; transferring the second composite color separation image, in registration with the first composite color separation image, onto the intermediate transfer member; similarly forming and developing a third composite color image using Cyan (C) and an optional color (X1) on a third tri-level xerographic module; transferring the third composite color separation image in registration with the first and second composite color separation images, onto the intermediate transfer member to form a desired final pictorial image. The method then includes a step of transferring the desired final pictorial image onto a substrate for fusing at a fusing station.

The embodiment of the present invention allows for two separate, but similar black (K1) marking materials, in each module of the first two trilevel xerographic modules so that magenta, M or cyan, C can be superimposed on black (K1 of the first module) and yellow, Y can also be superimposed on black (K2 of the second module). This thus advantageously enables all of the colors Y, M, C and K to be superimposable one on another as desired in order to obtain high quality pictorial images.

BRIEF DESCRIPTION OF THE DRAWINGS

In the detailed description of the invention presented below, reference is made to the drawing, in which.

DETAILED DESCRIPTION OF THE INVENTION

Figure 1:
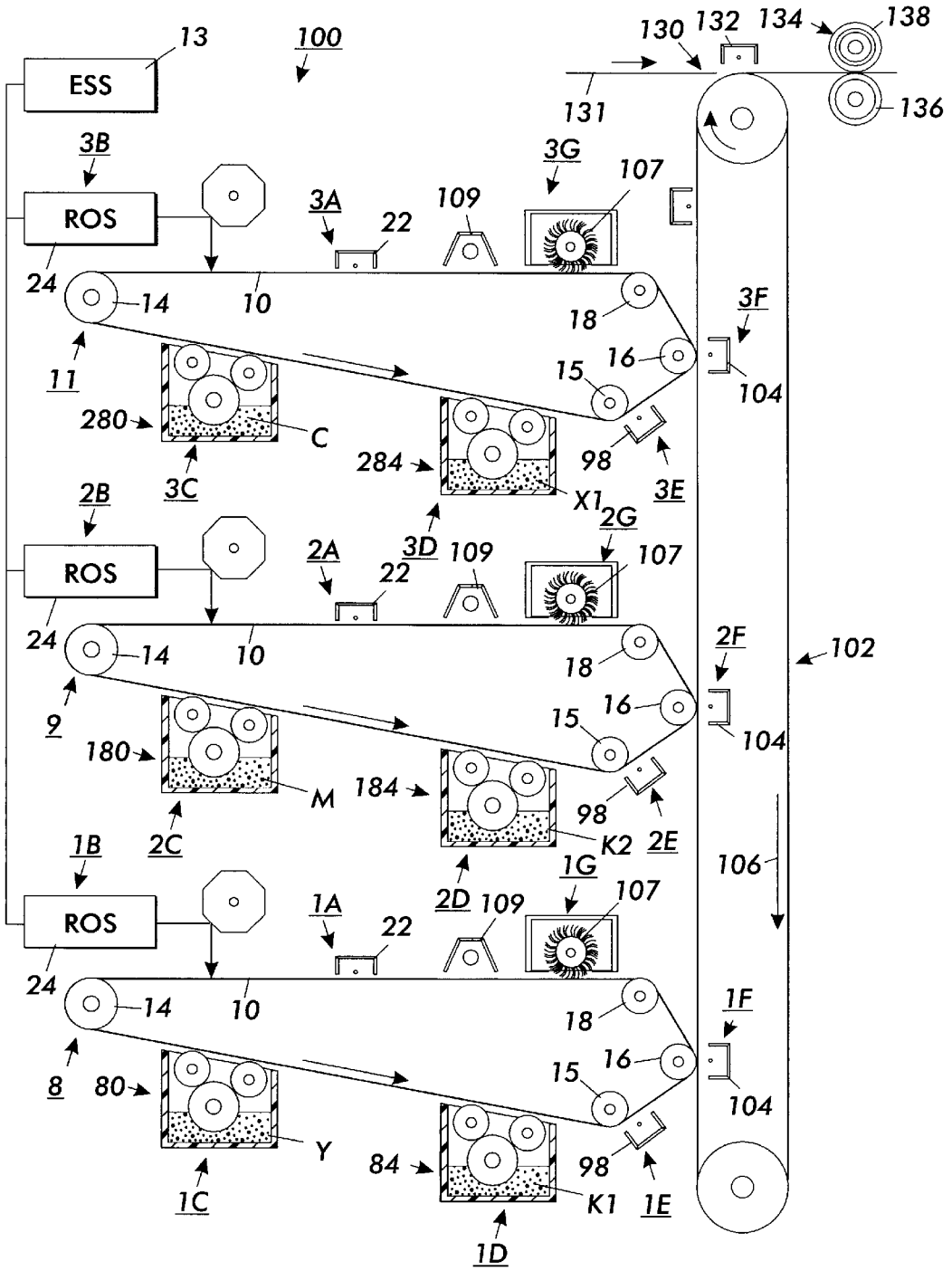
FIG. 1 is a schematic illustration of the tandem xerographic apparatus, for efficiently producing quality pictorial color images in accordance with the present invention.

Referring now to the drawing, FIG. 1, there is shown generally as 100, the tandem xerographic apparatus of the present invention, for efficiently producing quality pictorial color images in accordance with the present invention. As shown, the tandem xerographic apparatus 100 comprises three tri-level xerographic imagers or modules 8, 9 and 11 that each include a member in the form of a photoconductive belt structure 10 having a photoconductive surface with an electrically conductive substrate.

A tri-level xerographic imager or module as such is a xerographic apparatus in which tri-level charge latent images (latent images including at least three different levels of charge) are formed on a charged photoconductive surface, and then appropriately developed in a single pass with at least two different colors. Each such tri-level latent image thus includes a CAD (Charged Area Development) areas having a first level of charge for example, a DAD (Discharged Area Development) areas having a second level of charge, and background areas having a third level of charge.

In accordance with the present invention, quality pictorial color prints can be obtained efficiently in a single pass by superimposing, on a receiving substrate or intermediate member 102, the outputs of three tri-level Xerographic modules 8, 9 and 11 arranged in tandem in such a manner that each of the colors of the YMCK gamut are superimposable one on another. This concept uses proven tri-level development technology, has a non-reduced throughput rate, and employs belt photoreceptors that each are the same length as those used in ordinary products. As will be described below, such quality pictorial color prints are also made with one less ROS than a number of ROS devices needed with either conventional tandem or REaD architectures.

According to the present invention, a total of five colors (Yellow and a first black (K1) on the first module 8; Magenta and a second black (K2) on the second module 9; and Cyan and an optional color (X1) on the third module 11), are printed in groups of two colors as shown. In the first embodiment of the present invention (FIG. 1) each of the tri-level modules 8, 9 and 11, thus prints a different subtractive color separation, Yellow, Magenta, Cyan, (YMC), and at least two modules (8 and 9) also each print black (K1 and K2). One additional arbitrary optional color (X1) is then printed by the third module 11. This optional color, X preferably is any bright color such as red (R), green (G) or blue (B), in order to increase the output color gamut, or it can be a special custom color for logos and the like.

A controller or electronic control subsystem (ESS) 13, preferably in the form of a programmable microprocessor, is provided for controlling the various functions and aspects of the present invention, including the ROS formation of CAD and DAD latent images on each module 8, 9 and 11. The microprocessor controller 13 thus is connected to the ROS of each module and to other components and subsystems of the apparatus 100, and provides electrical command signals for operating all of such components and subsystems.

As shown (FIG. 1), in the first tri-level module 8 of the first embodiment, the belt 10 is mounted for movement past a series of xerographic process stations including a charging station 1A, a single exposure station 1B, a first development station 1C using yellow (Y) marking material, a second development station 1D using a first black (K1) marking material, a pretransfer charging station 1E, and a transfer station 1F.

In like manner, in the second tri-level imager module 9, the belt 10 is mounted for movement past a series of xerographic process stations including a charging station 2A, a single exposure station 2B, a first development station 2C, using Magenta (M) marking material, a second development station 2D using a second black (K2) marking material, a pretransfer charging station 2E, and a transfer station 2F.

Similarly in the third tri-level imager module 11, the belt 10 is mounted for movement past a series of xerographic process stations including a charging station 3A, a single exposure station 3B, a first development station 3C using Cyan (C) marking material, a second development station 3D using an optional color (X1) marking material, a pretransfer charging station 3E, and a transfer station 3F.

In each of the tri-level modules 8, 9 and 11, the belt 10 moves in the direction of arrow 12 in order to advance successive portions thereof sequentially through the various processing stations which are disposed about the path of movement of the belt 10. As shown on the first module 8, but also true of the other modules 9 and 11, belt 10 is entrained about a plurality of rollers 14, 15, 16 and 18. The roller 16 may be used as a drive roller and the roller 14 may be used to provide suitable tensioning of the belt photoreceptor 10.

As can be seen by further reference to FIG. 1, and for each of the modules 8, 9 and 11, initially successive portions of belt 10 pass through charging station 1A, 2A, 3A. At charging station 1A, 2A, 3A, a corona discharge device such as a scorotron, corotron or dicorotron indicated generally by the reference numeral 22, charges the belt 10 to a selectively high uniform positive or negative potential level. Any suitable control, well known in the art, may be employed for controlling the corona discharge device 22.

To summarize, the different color marking materials are arranged:

| | |
|---|---|
| First imaging module = Y | K1 |
| Second imaging module = M | $K_2$ |
| Third imaging module = C | X1 |

Next, in each imaging module, the uniformly charged portions of the photoreceptor surface of belt 10 are advanced through exposure station 1B, 2B, 3B. At exposure station 1B, 2B, 3B, each uniformly charged portion of the photoreceptor surface of belt 10 is exposed to a laser based output scanning device 24 which causes the charge retentive surface to remain charged or to be discharged in accordance with the output from the controller 13 through such scanning device 24.

The scanning device 24 is a multi-level, e.g. two-level (2 bit) Raster Output Scanner (ROS). The Electronic control SubSystem (ESS) 13, for example, may convert previously stored pictorial image data into appropriate control signals for use the ROS 24 in an imagewise fashion for exposing the belt 10. Such exposure results in the photoreceptor containing for example, latent electrostatic image areas having three different voltage levels (tri-level), as is well known in tri-level xerography. The three voltage levels correspond to background areas and two different image areas, namely CAD image areas and DAD image areas. For each module 8, 9 and 11, two development apparatuses (one at each development station), are thus provided for developing the two different image areas with different color toners, to be described below.

As illustrated further in FIG. 1, and with particular reference to the first tri-level imager module 8, the exposed portion of its belt photoreceptor 10 with a first tri-level image including the CAD and DAD image areas thereon next moves to the first development station 1C. As shown, the first development station 1C includes a development unit 80 containing yellow, Y marking material in accordance with the present invention. As the CAD image on the exposed portion moves past the development unit 80, it is appropriately developed as a first image separation with the yellow, Y marking material. The development unit 80 can be a Non Interactive Development (NID) device or a magnetic brush development device since the CAD image is the first image being developed.

Next, the belt 10 moves the tri-level image (now including the (CAD) yellow developed image) past the second development station 1D. As also shown, the second development station 1D includes a second development unit 84 containing a first black, K1 marking material. The second development unit 84 thus appropriately deposits the first black, K1 marking material onto the DAD areas of the tri-level image to form a second separation image in a "dot-next-to-dot manner" relative to the Y image, and thus forming a first composite color separation image (Y next to K1) of the desired, final pictorial image, on the belt 10. Development unit 84 preferably employs soft magnetic brush development technology. The black in this module corresponds either to the black of the final image or to the equivalent subtractive colors of Y, C and M of the final image.

Following such development, the first composite color separation image (Y next to K1) is moved to the pretransfer charging station 1E. Because the first composite color separation image developed appropriately on the photoreceptor consists of both positive and negative marking material, a typically positive pretransfer corona discharge member 98 disposed at the pretransfer charging station is provided for conditioning the marking material or toner for effective subsequent transfer at a transfer station using positive corona discharge. The pretransfer corona discharge member is preferably an AC corona device biased with a DC voltage to operate in a field sensitive mode and to perform tri-level xerography pretransfer charging in a way that selectively adds more charge (or at least comparable charge) to the part of composite tri-level image that must have its polarity reversed compared to elsewhere.

The first composite color separation image (Y next to K1) is subsequently transferred, at the transfer station 1F using a transfer corona device 104, onto an Intermediate transfer member or Transfer Belt (ITB) 102 which is supported in intimate contact with the photoreceptor 10 for synchronous movement therewith. As shown, transfer station 1F includes the corona generating device 104 which sprays ions of a suitable polarity onto the backside of belt 102. This attracts the charged toner powder forming the first composite color separation image (Y next to K1) from the photoreceptor belt 10 onto the ITB 102. After transfer, the ITB continues to move, in the direction of arrow 106 towards the second tri-level module 9 of the present invention.

After the first composite image (Y next to K1) has been transferred to the ITB 102 from a portion of the photoconductive surface of belt 10, residual toner or marking particles left on such portion of the surface of the belt 10 are removed at cleaning station 1G including, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

With particular reference now to the second tri-level imager module 9, the condition of its photoreceptor belt 10 (after exposure by the ROS 24 under control of the ESS 13) is such that it contains a second tri-level image. Similarly, its tri-level image also includes charged image areas for CAD, discharged image areas for DAD, and background areas. As illustrated further, the exposed portion of the belt photoreceptor 10 of the second module with the tri-level image thereon next moves to the first development station 2C of module 9.

As shown, the first development station 2C includes a development unit 180 containing magenta, M marking material in accordance with the present invention. As the CAD image on the exposed portion moves past the development unit 180, the CAD image is appropriately developed as a first image separation thereon with the magenta, M marking material. The development unit 180 can be a Non Interactive Development (NID) device or a magnetic brush development device since the CAD image is the second image being developed.

Next, the belt 10 moves the tri-level image (now including the (CAD) magenta, M developed image) past the second development station 2D. As also shown, the second development station 2D includes a second development unit 184 containing a second black, K2 marking material1. The second development unit 184 deposits its second black, K2 marking material onto the DAD image area of the tri-level image of this module forming a second black K2 separation image, and thus forming a second composite color separation image (M next to K2) of the desired, final pictorial image, on the belt 10. Development unit 184 preferably employs soft magnetic brush development technology. The second black K2 in this module can be controlled and developed only when spot-on-spot or color superimposition development is required.

Following such development, the second composite color separation image (M next to K2) is moved to the pretransfer charging station 2E. Because the second composite color separation image developed appropriately on the photoreceptor consists of both positive and negative marking material, a typically positive pretransfer corona discharge member 98 disposed at the pretransfer charging station is provided for conditioning the marking material or toner for effective subsequent transfer at a transfer station using positive corona discharge. The pretransfer corona discharge member is preferably an AC corona device biased with a DC voltage to operate in a field sensitive mode and to perform tri-level xerography pretransfer charging in a way that selectively adds more charge (or at least comparable charge) to the part of composite tri-level image that must have its polarity reversed compared to elsewhere.

The second composite color separation image (M next to K2) is subsequently transferred, at the transfer station 2F using a transfer corona device 104, onto an Intermediate transfer member or Transfer Belt (ITB) 102 which is supported in intimate contact with the photoreceptor 10 for synchronous movement therewith. As shown, transfer station 2F includes the corona generating device 104 which sprays ions of a suitable polarity onto the backside of belt 102. This attracts the charged toner powder forming the second composite color separation image (M next to K2) from the photoreceptor belt 10 onto the ITB 102. Importantly in accordance with the present invention, the duplication of black marking material as K1 and K2 on two different imaging modules, advantageously enables and allows superimposition of Y on K2, and M on K1. After such transfer, the ITB continues to move, in the direction of arrow 106 towards the third tri-level module 11 of the present invention.

After the second composite image (M next to K2) has been transferred to the ITB 102 from a portion of the photoconductive surface of belt 10 of module 9, residual toner or marking particles left on such portion of the surface of the belt 10 are removed at cleaning station 2G. As shown, cleaning station 2G is similar to cleaning station 1G and thus includes, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

Now with particular reference to the third tri-level imager module 11, the condition of its photoreceptor belt 10 (after exposure by the ROS 24 under control of the ESS 13) is also such that it contains a third tri-level image. As such, the third tri-level image includes charged image areas for CAD, discharged image areas for DAD, and background areas. As illustrated further, the exposed portion of the belt photoreceptor 10 of the third module 11 with the tri-level image thereon next moves to the first development station 3C thereof. As shown, the first development station 3C includes a development unit 280 containing cyan, C marking material in accordance with the present invention. As the CAD image on the exposed portion moves past the development unit 280, the CAD image is appropriately developed as a first image separation thereon with the cyan, C marking material. The development unit 280 can be a Non Interactive Development (NID) device or a magnetic brush development device since the CAD image is the first image being developed on this belt 10.

Next, the belt 10 moves the tri-level image (now including the (CAD) cyan, C developed image) past the second development station 3D. As also shown, the second development station 3D includes a second development unit 284 containing an optional color X1. This optional color X1 can include any bright colors such as red (R), green (G) or blue (B), in order to increase the output color gamut, or it can be a special custom color for logos and the like.

The second development unit 284 thus deposits the optional color marking material (X1) onto the DAD image area of the tri-level image of this module thus forming a second separation image thereon X1, and thus forming a third composite color separation image (C next to X1) of the desired, final pictorial image, on the belt 10. Development unit 284 preferably employs soft magnetic brush development technology. Alternatively, if there is no requirement for a special optional color X1, it can be replaced on the third module by yet a third black K3, marking material which would also allow a spot to be formed from superposition of Y+M+K3.

Following such development, the third composite color separation image is (C next to X1) is moved to the pretransfer charging station 3E. Because the third composite color separation image developed appropriately on the photoreceptor consists of both positive and negative marking material, a typically positive pretransfer corona discharge member 98 disposed at the pretransfer charging station is provided for conditioning the marking material or toner for effective subsequent transfer at a transfer station using positive corona discharge. The pretransfer corona discharge member is preferably an AC corona device biased with a DC voltage to operate in a field sensitive mode and to perform tri-level xerography pretransfer charging in a way that selectively adds more charge (or at least comparable charge) to the part of composite tri-level image that must have its polarity reversed compared to elsewhere.

The third composite color separation image (C next to X1) is subsequently transferred, at the transfer station 3F using a transfer corona device 104, onto an Intermediate transfer member or Transfer Belt (ITB) 102 which is supported in intimate contact with the photoreceptor 10 for synchronous movement therewith. As shown, transfer station 3F includes the corona generating device 104 which sprays ions of a suitable polarity onto the backside of belt 102. This attracts the charged toner powder forming the third composite color separation image (C next to X1) from the photoreceptor belt 10 onto the ITB 102. Further superimpositions as listed below are also enabled. After transfer, the ITB 102, with the desired final pictorial image thereon continues to move, in the direction of arrow 106 towards a substrate transfer station 130 where the pictorial image is transferred onto a sheet for fusing.

After the third composite image (C next to X1) has been transferred to the ITB 102 from a portion of the photoconductive surface of belt 10 of module 11, residual toner or marking particles left on such portion of the surface of the belt 10 are removed at cleaning station 3G. As shown, cleaning station 3G is similar to cleaning station 1G and thus includes, for example, a conventional cleaning brush roll 107. It may also include a pair of detoning rolls (not shown) for removing the residual toner from the brush. Other cleaning systems, such as fur brush or blade, are also suitable. Subsequent to such cleaning, a discharge lamp 109 may be used to flood that portion of the photoconductive surface of belt 10 with light in order to dissipate any residual electrostatic charge remaining on such portion, prior to the recharging of such portion for each successive imaging cycle.

Note that conventional tri-level approaches are ordinarily not capable of producing a full color gamut pictorial image because the two colors that make up any composite tri-level image from a tri-level module cannot be superimposed effectively. This is because they are mutually exclusive. For example, if a tri-level image is printed using colors A & B on a first tri-level module, and then superimposed over a second tri-level image printed with colors D & E on a second tri-level module, it is possible to obtain the colors A+D, A+E, B+D, and B+E in addition to colors A, B, D and E. However, it is not possible to obtain the colors A+B or D+E. In this case, if ABDE represented KYMC, it would not be possible to print blue (M+C) or overprint yellow on black (Y+K). In the present invention, this is made possible by having the second colors of both module 1 and 2, be black (K1), (K2) which can be identical or in which the second black K2 has a different density.

However in accordance with the present invention, the different color marking materials not only form Y; K1; K2; M; C and X1; as (Y next to K1); (M next to K2); and (C next to X1); as described above, but upon transfer onto the ITB, the various colors can also be effectively superimposed (one on top of the other, not just next to each other) as follows:

C+M; C+K1; C+Y; C+K2

M+K1; M+Y

X1+M; X1+K1 or K2; X1+Y, thus maximizing the color gamut and achieving pictorial quality images from xerography.

At the substrate transfer station 130, the final pictorial quality image is transferred from the ITB 102 onto a final substrate 131, such as plain or coated paper. A transfer corona discharge device 132 preferably is provided for facilitating such transfer. Transfer can also be accomplished with a biased transfer roll in place of the corona generating device.

The substrate 131 with the transferred image thereon is then moved to a fuser assembly, indicated generally by the reference numeral 134, which permanently affixes the transferred image to substrate 131. Preferably, fuser assembly 134 comprises a heated fuser roller 136 and a pressure roller 138. Substrate 131 passes between fuser roller 136 and pressure roller 138 with the toner powder images contacting fuser roller 136. In this manner, the toner powder image is permanently affixed to substrate 131. After fusing, a chute, (not shown), guides the advancing substrate 131 to a catch tray, also (not shown), for subsequent removal from the machine 100 by the operator.

Thus quality pictorial color images can be obtained in a single pass by forming YK1MK2CX1 color separation images on the three tri-level Xerographic modules 8, 9, and 11, as well as desired, superimposing these color separation images one on top of the other to yield additional final image color gamut portions comprising C+M; C+K1; C+Y; C+K2; M+K1; M+Y; and X1+M; X1+K1 or K2; X1+Y. Additionally, the throughput rate of the cyclical machine 100 of the present invention advantageously is equal to the speed of each module, and each module employs a photoreceptor that is the same length as those used in conventional products. As shown in FIG. 1, the first tri-level module 8 prints yellow Y and a first black K1, the second module 9 prints magenta M and a second black K2, while the third module 11, prints cyan, C and an optional color X1 which can be a special logo or bright color (red, blue or green).

Advantageously, in the tandem tri-level xerographic machine or apparatus of the present invention there is no requirement to expose through a previously developed separation image, and all composite color separations (Y next to K1), (M next to K2) and (C next to X1) transfer onto the ITB with great efficiency. The print throughput rate is same as the process speed of individual tri-level modules 8, 9, and 11. Additionally, the modular architecture of the machine 100 eliminates any need for continuous, very long (12 foot) photoconductor belts which are currently very difficult to manufacture. When compared to any other tandem single pass color imaging system, it also requires one less module (it uses three instead of four modules), and one less ROS assembly. Consequently, only three composite color separations need to be registered (instead of four or five conventionally) in order to produce the desired final pictorial color image. Each such registration involves adding already perfectly registered, tri-level two color separations (Y next to K1), (M next to K2) and (C next to X1).

As can be seen, there has been provided apparatus and method for creating quality pictorial color images. Apparatus and method for creating quality pictorial color images include a charging device for uniformly charging a photoconductive member of a first tri-level xerographic module to a predetermined voltage level; using a controller and a ROS device for creating tri-level latent electrostatic images including CAD image areas and DAD image areas having different voltage levels respectively; developing the CAD image areas and the DAD image areas with yellow (Y) and a first black (K1) marking materials respectively to form a first composite color separation image of a desired final pictorial image; transferring the first composite color separation image onto an intermediate transfer member; similarly forming and developing a second composite color separation image on a second tri-level xerographic module using Magenta (M) and a second black (K2) marking material; transferring the second composite color separation image, in registration with the first composite color separation image, onto the intermediate transfer member such that yellow Y and the second black K2 are superimposable; similarly forming and developing a third composite color separation image on a third tri-level xerographic module using Cyan (C) and an optional color (X1); transferring the third composite color separation image in registration with the first and the second composite color separation images, onto the intermediate transfer member to form a desired final pictorial image including desired color superimpositions; and transferring the desired final pictorial image at a substrate transfer station onto a substrate for fusing.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A method of creating quality pictorial color images in a single pass using tri-level xerographic modules in tandem, said method including the steps of:

uniformly charging a photoconductive member of a first tri-level xerographic module to a predetermined voltage level;

creating tri-level latent electrostatic images including CAD image areas and DAD image areas having different voltage levels respectively;

developing the CAD image areas and the DAD image areas with yellow (Y) and a first black (K1) marking materials respectively to form a first composite color separation image of a desired final pictorial image;

transferring the first composite color separation image onto an intermediate transfer member;

uniformly charging a photoconductive member of a second tri-level xerographic module to a predetermined voltage level;

creating tri-level latent electrostatic images including CAD image areas and DAD image areas having different voltage levels respectively;

developing the CAD image areas and the DAD image areas with Magenta (M) and a second black (K2), marking materials respectively to form a second composite color separation image of the desired final pictorial image;

transferring the second composite color separation image, in registration with the first composite color separation and such as to superimpose Y on K2 and M on K1, onto the intermediate transfer member;

uniformly charging a photoconductive member of a third tri-level xerographic module to a predetermined voltage level;

creating tri-level latent electrostatic images including CAD image areas and DAD image areas, having different voltage levels respectively;

developing the CAD image areas and the DAD image areas with Cyan (C) and an optional color (X1), marking materials respectively to form a third and final composite color separation of the desired final pictorial image;

forming a desired final pictorial image on the intermediate transfer member by transferring the third composite color separation image, in registration with the first and second composite color separation images, onto the intermediate transfer member; and transferring the desired final pictorial image onto a substrate for fusing.

2. The method of claim 1, wherein each of said steps of creating tri-level latent electrostatic images includes using a controller and a single exposure device operating at two different levels.

3. The method of claim 1, wherein said second black (K2) material has a density different from that of the first black (K1) marking material.

4. A tandem xerographic apparatus for creating quality pictorial color images in a single pass, the tandem xerographic apparatus comprising:

(a) a first tri-level xerographic module including:

(i) a charging device for uniformly charging a photoconductive member thereof to a predetermined voltage level;

(ii) a controller and a ROS device for creating tri-level latent electrostatic images including CAD image areas and DAD image areas having different voltage levels respectively;

(iii) first and second development units for developing said CAD image areas and said DAD image areas with yellow (Y) and black (K1) marking materials respectively to form a first composite color separation image of a desired final pictorial image; and (iv) a transfer station for transferring said first composite color separation image onto an intermediate transfer member;

(b) a second tri-level xerographic module including:

(i) a charging device for uniformly charging a photoconductive member thereof to a predetermined voltage level;

(ii) a controller and a ROS device for creating tri-level latent electrostatic images including CAD image areas and DAD image areas having different voltage levels respectively;

(iii) first and second development units for developing said CAD image areas and said DAD image areas with Magenta (M) and black, (K2) marking materials respectively to form a second composite color separation image of the desired final pictorial image;and (iv) a transfer station for transferring said second composite color separation image, in registration with said first composite color separation image, onto the intermediate transfer member;

(c) a third tri-level xerographic module including:

(i) a charging device for uniformly charging a photoconductive member thereof to a predetermined voltage level;

(ii) a controller and a ROS device for creating tri-level latent electrostatic images including CAD image areas and DAD image areas having different voltage levels respectively;

(iii) first and second development units for developing said CAD image areas and said DAD image areas with Cyan (C) and an optional color (X1), marking materials respectively to form a third composite color separation image of the desired final pictorial image; and (iv) a transfer station for transferring said third composite color separation image, in registration with said first and said second composite color separation images, onto said intermediate transfer member to complete the desired final pictorial image; and (d) a substrate transfer station for transferring the desired final pictorial image onto a substrate for fusing at a fusing station.

5. The tandem xerographic apparatus of claim 4 wherein said optional color comprises a third black marking material superimposable on Y+M.

6. The tandem xerographic apparatus of claim 4 wherein said first, second and third tri-level xerographic modules form YK1MK2CX1 color separation toner images and transfer said YK1MK2CX1 onto said intermediate transfer member so as to form additional final image color gamut portions comprising C+M; C+K1; C+Y; C+K2; M+K1; M+Y; and X1+M; X1+K1 or K2; X1+Y.

* * * * *